United States Patent [19]

Hoshino

[11] 4,453,446

[45] Jun. 12, 1984

[54] TOM-TOM HOLDER

[75] Inventor: Yoshihiro Hoshino, Nagoya, Japan

[73] Assignee: Hoshino Gakki Company, Ltd., Japan

[21] Appl. No.: 444,472

[22] Filed: Nov. 24, 1982

[30] Foreign Application Priority Data

Jun. 25, 1982 [JP] Japan ..... 57-96097

[51] Int. Cl.[3] ..... G10D 13/02

[52] U.S. Cl. ..... 84/421

[58] Field of Search ..... 84/411 R, 421

[56] References Cited

U.S. PATENT DOCUMENTS

| | | | |
|---|---|---|---|
| 2,844,064 | 7/1958 | Bendett | 84/421 |
| 3,191,484 | 6/1965 | Walling | 84/421 |
| 3,535,976 | 10/1970 | Osuga | 84/421 |
| 3,893,363 | 7/1975 | Cohen | 84/421 X |
| 3,945,291 | 3/1976 | Zickos | 84/421 |
| 4,337,684 | 7/1982 | Le Mert | 84/421 |

FOREIGN PATENT DOCUMENTS

| | | |
|---|---|---|
| 56-7998 | 2/1981 | Japan . |
| 56-55896 | 5/1981 | Japan . |

OTHER PUBLICATIONS

Standard and Commercial Fixture Components, Ch. 17, p. 206.

*Primary Examiner*—Donald A. Griffin

*Attorney, Agent, or Firm*—Ostrolenk, Faber, Gerb & Soffen

[57] ABSTRACT

The disclosure concerns a tom-tom holder for supporting a pair of tom-toms on a stand. The holder has two arms which are pivotally attached to each other at an upright support rod. Each arm includes a hinge ball pressing part above and a hinge ball receiving part below, which parts are hinged together to pivot toward and away from each other for clamping a hinge ball between them. The hinge ball has an attached rod for holding a drum. The ball is clamped at a selected orientation through a cam mechanism comprising a rod extending from the ball pressing to the ball receiving element and being attached to the ball receiving element through a nut screwed onto the rod. A cam is attached to the rod at the ball pressing element. The cam is adjustable in its orientation for pressing upon the ball pressing element for drawing the rod and the attached ball receiving element into a hinge ball clamping position with respect to the ball pressing element.

12 Claims, 4 Drawing Figures

TOM-TOM HOLDER

BACKGROUND OF THE INVENTION

The present invention relates to a tom-tom holder, and particularly a holder which supports two tom-toms and is adjustable for varying the relative positions of the tom-toms.

A holder for supporting two tom-tom drums includes a pair of arms radiating from a central support rod. Toward the end of each arm there is a support for an individual tom-tom. In one known embodiment, this support comprises an arm for supporting the tom-tom, and the arm is received in a ball, which is essentially universally rotatable and which is clamped at the end of the arm at an orientation giving the two supported tom-toms the desired spacing and orientation. See, for example, U.S. patent application Ser. No. 201,465, filed Oct. 28, 1980, "Universal Swivel Holder for Drums, or the Like", showing one technique for clamping a ball at the end of an arm of the support.

The above-described tom-tom holder is limited in the range of relative positions which can be selected for the two supported tom-toms. Because the two arms of the support are integrated and are not relatively movable, it is not possible to move the pair of tom-toms relative to one another outside the range permitted by adjustment of their supporting rods, through adjustment of the respective balls to which the supporting rods are attached.

SUMMARY OF THE INVENTION

Accordingly, it is the primary object of the invention to increase the range of adjustments of the relative positions of two tom-toms supported on a single tom-tom holder.

It is another object of the invention to ease the steps of clamping and releasing the individual universal hinges or balls for the tom-toms to facilitate their relative adjustments.

According to the invention, the tom-tom holder includes a main body which is bifurcated into two arms which are hinged to each other about a vertical axis at or near the main support rod of the stand, so that the two arms can pivot horizontally around their vertical axis, thereby adjusting the distance between the arms and the relative positions of the tom-toms supported at the arms.

At the end of each arm is a universal, clampable hinge ball for supporting a rod on which an individual tom-tom is supported. The ball is clamped into a pocket defined by an upper ball pressing part and a lower ball receiving part of the respective arm. The parts of the arm are clamped together through the use of cam means which are movable between a position drawing the upper and lower sections of the arm together and another position permitting them to separate or to be biased apart by a spring.

The foregoing and other objects and features of the invention will become apparent from the following description of a prior art embodiment and of the preferred embodiment of the invention, as shown in the accompanying drawings.

BRIEF DESCRIPTION OF THE DRAWING FIGURES

DESCRIPTION OF A PRIOR ART EMBODIMENT

Figure 1:
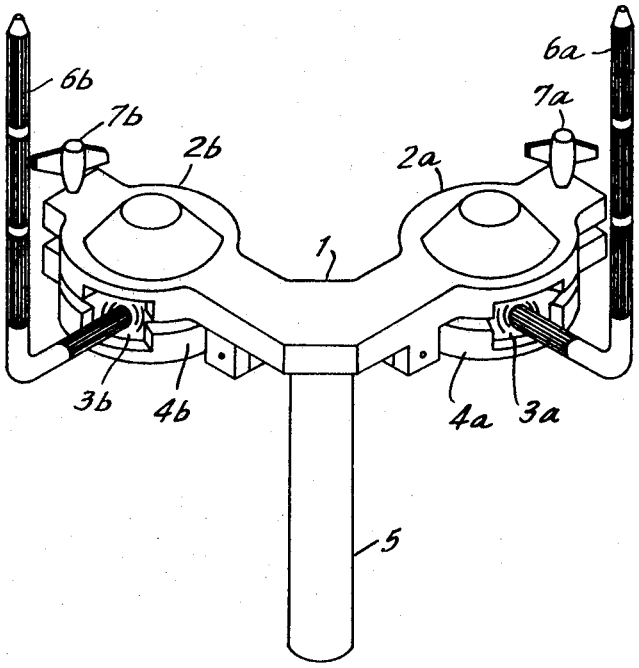
FIG. 1 is a perspective view of a prior art embodiment of a holder for holding two tom-toms.

A tom-tom holder holds two relatively small diameter tom-tom drums (not shown). In FIG. 1, the tom-tom holder comprises a main holder body 15 which is bifurcated into two arms which are integral with each other and generally meet at an acute angle. The main holder body 1 is fixed to the drum stand rod 5, which rests on a support base (not shown). Each arm of the holder is divided into an upper hinge ball pressure applying part 2*a* or 2*b* and a lower hinge ball receiving part 4*a* or 4*b*. In the pocket defined between the upper and lower ball parts, a respective universally rotatable hinge ball 3*a* or 3*b* is positioned. Each ball supports a respective L-shaped rod 6*a* or 6*b*, and these rods protrude from the enlarged slot on the side of the tom-tom holder having the obtuse angle between the arms. Once the desired orientation and spacing for the tom-toms is established by twisting and rotating the rods 6*a* and 6*b* with the ball engaging parts 2*a*, 2*b* and 4*a*, 4*b* loosened with respect to each other, the clamping screws 7*a* and 7*b* are tightened. The tightening respectively draws the upper and lower ball clamping parts 2*a*, 4*a* and 2*a*, 4*b* together, for clamping the balls 3*a*, 3*b* and the respective rods 6*a*, 6*b* at the selected orientations and distance apart.

Because the main holder body 1 is formed integrally in a bifurcated form, movement of the pair of tom-toms outside the range permitted by the twisting and reorientation of the L-shaped rods 6*a*, 6*b* on the universal hinge ball 3*a*, 3*b* is prohibited.

DESCRIPTION OF A PREFERRED EMBODIMENT

Figure 2:
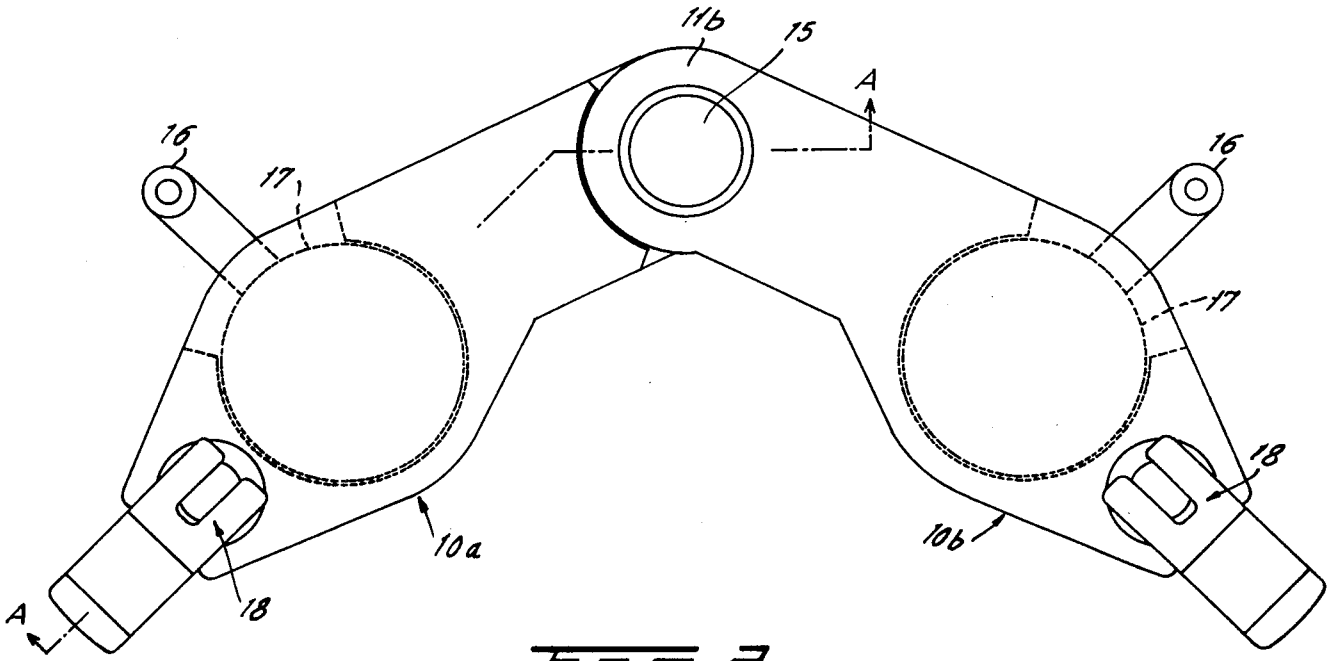
FIG. 2 is a top plan view of a tom-tom holder for holding two-tom-toms, according to the invention.
Figure 3:
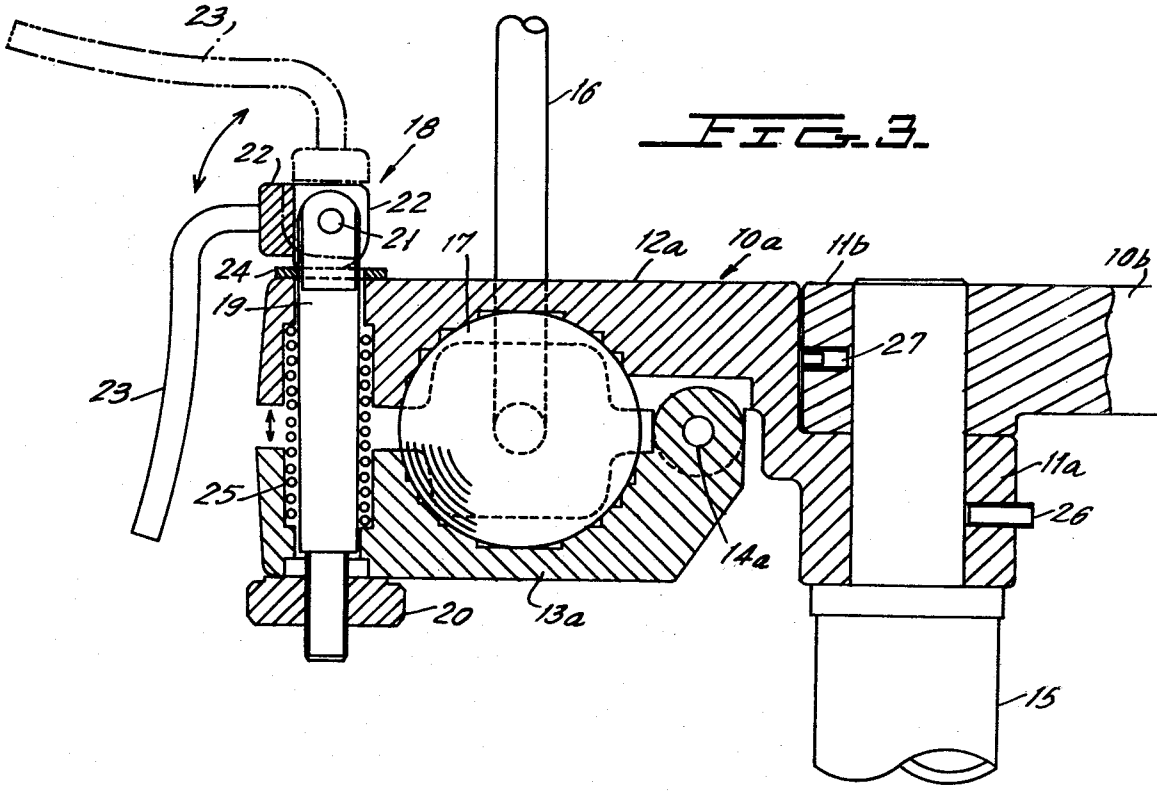
FIG. 3 is a cross-sectional view of the holder of FIG. 2, taken along lines A—A.
Figure 4:
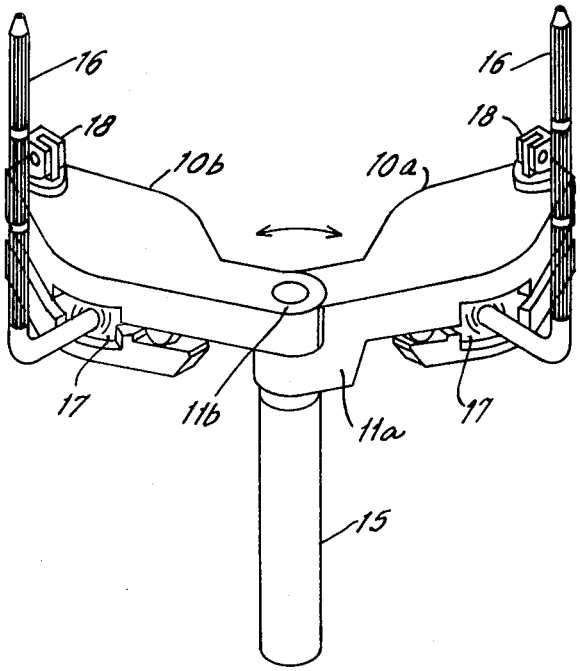
FIG. 4 is a perspective view of the tom-tom holder according to the invention.

The tom-tom holder is supported on an upstanding vertical rod 15 of the support stand. Referring to FIGS. 2–4, the main holder body of the tom-tom holder of the invention is comprised of a left side holder arm 10*a* and a separate right side holder arm 10*b*. These two arms are rotatably journaled on the vertical rod 15 at the respective bases 11*a* and 11*b* of the arms 10*a* and 10*b*. The rod 15 narrows where it receives the bases 11*a* and 11*b*, for supporting the bases at the top of the rod that they not slip down. Except for the configuration of the bases 11*a* and 11*b* which overlie one another, both the left and right holder body arms 10*a* and 10*b* are identically symmetrical in construction. The base 11*a* of the left side holder 10*a* is fixed to the upper portion of the rod 15 by the fixing screw 26. Correspondingly, there is a fixing screw 27 which fixes the base 11*b* of the right side holder 10*b* to the rod 15.

Because the left side holder body arm 10*a* and the right side holder body arm 10*b* are identically symmetrical, only the former is now described with reference to FIG. 3. The arm 10*a* is divided into an upper section 12*a* which serves as a universal hinge ball pressing part and a lower section 13*a* which serves as a hinge ball receiving part.

The underside of the upper section 12*a* and the upper side of the bottom section 13*a* are both concavely recessed for together defining a pocket for the hinge ball 17.

The universal hinge ball 17 is placed in the pocket and the ball and the concave recesses defining the pocket are respectively curved that the ball will be securely nested and held in the pocket when the sections defining the pocket are clamped securely together. The interior surfaces of the concave pockets in the upper and lower sections 12*a* and 13*a* are stepped or profiled to provide more secure grip upon the ball 17 in the pocket.

The lower section 13*a* is hinged to the upper section 12*a* at hinge axis 14*a* located on the side of the ball 17 toward the rod 15. The sections 12*a* and 13*a* are selectively movable apart to permit adjustment of the orientation of the ball 17 and are clampable together for securely holding the ball 17 in a selected orientation.

An L-shaped rod 16 projects from a side of the ball and projects through the enlarged slot at the side of the sections 12*a*, 13*a* which faces on the side of the holder body arms that are at an obtuse angle with respect to each other.

In place of a clamping screw which could be simply tightened to securely clamp the sections 12*a* and 13*a* together to hold the ball 17 securely, a cam-type clamping tool 18 is provided for selectively permitting the upper and lower sections 12*a* and 13*a* to hingedly move apart to free the ball 17 to move, and to move those sections together to securely clamp on the hinge ball 17. The clamping tool comprises an elongate rod 19 which extends from above the upper section 12, through a vertically extending opening in the upper section, through an aligned vertically extending opening in the lower section and out beneath the lower section 13*a*. The outwardly projecting lower end portion of the rod 19 is externally threaded. An adjusting nut 20 is screwed onto the threaded lower end of the rod 19 and against the underside of lower section 13*a*. This adjusts the protruding length of the tip of the rod 19, for adjusting the degree of tightness of the clamping of the sections 12*a* and 13*a* together for the particular holder body 10 and ball 17 here provided.

At the top of the rod 19, a cam 22 is provided. It is journaled at the cam axis 21 at the upwardly protruding tip end of the rod 19, whereby the cam 22 may pivot between its down, solid line position and its up, broken line position. The cam is shaped so that there is a longer distance between the cam surface and its pivot axis 21 with the cam in the clamping, lever down, solid line position in FIG. 3 as compared with the cam being in the released lever upraised position shown in broken lines in FIG. 3.

A manually operable cam moving lever 23 is attached at the rear side of the cam for moving the same. The cam has its front face, on the side opposite the side to which the lever 23 is attached, and its adjacent side face, facing downwardly in solid line in FIG. 3, which serve as the two cam faces of the cam 22. The cam is in the shape of a U, so as to be able to engage the end of the rod 19.

A seat 24 for the cam is placed on top of the section 12*a*, so that the cam may rub against and press upon the seat 24.

The compressed coil spring 25 located inside the widened portions of the openings in the upper and lower sections 12*a* and 13*a* normally biases these sections apart, freeing the hinge ball 17 to be rotated, and the clamping means cam is operable from its released position permitting the ball to be rotated to its clamping position, in opposition to the bias of the spring 25, for clamping the sections 12*a* and 13*a* against the hinge ball.

Accordingly, when the lever 23 is lowered to the solid line position, the cam 22 rides along the cam seat 24 and raises the rod 19 which, through the nut 20, raises the lower section 13*a* against the top section 12*a*, which tightens these sections securely against the hinge ball 17.

Correspondingly, when the lever 23 is upraised to its broken line position, this raises the lower face of the cam upward and the ball pressing section 12*a* is permitted to rise away from the ball receiving section 13*a*, and these are separated sufficiently that the clamping force on the hinge ball 17 is loosened, which permits the ball to rotate.

The tom-tom holder just described has its two arms 10*a* and 10*b* adjusted around the axis defined by the rod 15 so that they are at a desired separation for the particular tom-toms involved and for the particular performer using them. Then the arms 10*a*, 10*b* are fixed in the selected position by the fixing screws 26 and 27. Because the arms 10*a* and 10*b* of the tom-tom holder can be adjusted to different angles of separation, this makes it possible to carry out a wider range of adjustments of the positions of the pair of supported tom-toms, as compared with the fixed adjustment angle of the arms of the conventional tom-tom holder. With the conventional holder, only the orientation of the rods 16 will determine the separation between the two tom-toms.

Two tom-toms are installed, one each on a respective L-shaped rod 16 for each arm. While the clamping means 18 is loosened, the angle and direction of the striking face of the tom-tom is established. Thereafter, the respective lever 23 is lowered from its broken line to its solid line position, which draws the sections 12*a* and 13*a* of the holder 10*a* together, which thereby fixes the hinge ball 17, the attached rod 16 and the supported tom-tom (not shown) to desired orientation. The tightening force to be exerted upon the ball 17 can be adjusted by adjusting the screw 20. The same thing is done with the holder 10*b*. The tightening and loosening of the clamping means is most easily effected using the cam member, as compared with the more time consuming tightening of a screw clamp in the prior art apparatus. Accordingly, with the invention, more accurate adjustments to the position and spacing of the tom-toms of a pair tom-toms can be effected.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A holder for a pair of tom-tom drums, or the like, comprising:

a main holder body, comprising a first and a second arm, and the first and second arms being pivotaly attached together for pivoting horizontally around a vertical axis to which the arms are pivotally attached;

each arm having an end portion away from the pivot axis thereof; the end portion of each arm comprising a hinge ball pressing part and a hinge ball receiving part; a hinge ball located between the respective pressing and receiving parts of the respective arm; drum support means attached to the ball such that adjustment of the orientation of the ball between the respective pressing and receiving parts also adjusts the orientation of the drum support means and will adjust the orientation of a drum supported on the drum support means;

clamping means for each arm and being movable for selectively moving the pressing and receiving parts of that arm to a clamping position for clamping the hinge ball at a selected orientation and to a released position at which the hinge ball is free to have its orientation readjusted.

2. The holder of claim 1, wherein the clamping means comprises a cam movable between the clamping position at which the cam urges the ball pressing and receiving parts together, and the released position, at which the cam permits the ball pressing and receiving parts to move apart.

3. The holder of claim 2, wherein the drum support means comprises an L-shaped rod, with one arm of the L-shaped rod projecting out of the ball and the other arm of that rod being for supporting a drum thereon.

4. The holder of claim 2, wherein the ball receiving and ball pressing parts on a respective arm are hinged together to pivot toward and away from each other under the action of the cam.

5. The holder of claim 2, wherein the cam comprises a rod extending between the ball pressing and ball receiving parts on the respective arms; a cam element attached to one end of the arm and also engaging one of the ball pressing and receiving elements, the cam element being shaped so that at a first orientation of the cam element, the cam element draws the rod out of the respective one of the pressing and receiving parts which the cam element engages, which moves the parts to the clamping position, so that at a second orientation of the cam element, the cam element enables the rod to move back into that one of the pressing and receiving elements which the cam element engages which moves the parts to the released position; the rod being attached to the other of the pressing and receiving elements, for moving that other element together with the movement of the rod.

6. The holder of claim 5, further comprising a spring for urging the ball pressing and receiving parts on a respective arm apart, and the cam element in the first orientation thereof moving the ball pressing and receiving parts together against the bias of the respective spring.

7. The holder of claim 6, wherein the ball receiving and ball pressing parts on a respective arm are hinged together to pivot toward and away from each other under the action of the cam.

8. The holder of claim 5, further comprising a lever attached to the cam element for moving the cam element between its orientations.

9. The holder of claim 5, wherein the cam element is pivotally attached to the rod to pivot between its first and second orientations.

10. The holder of claim 5, wherein the rod being attached to the other of the ball pressing and receiving elements comprises the rod being screw threaded and comprises a nut adjustably screwed onto the threaded rod and being in engagement with the other of the pressing and receiving elements, whereby adjustment of the nut on the rod adjusts the position of that other element along the rod.

11. A holder for a pair of tom-tom drums, or the like, comprising:

a main holder body, comprising a first and a second arm, and the arms being pivotally attached together for pivoting horizontally around a vertical axis to which the arms are pivotally attached;

each arm having an end portion away from the pivot axis thereof; the end portion comprising a drum support for supporting a respective tom-tom drum at the end portion of the arm; the drum support being movable in its orientation with respect to the arm for adjusting the orientation of a tom-tom drum supported on the drum support; clamping means for clamping the drum support at the end of the arm at a selected orientation.

12. The holder of claim 11, wherein the clamping means comprises two cooperating clamping elements movable for engaging the drum support for holding the drum support at a selected orientation and comprises a cam movable between a clamping position, at which the cam urges the cooperating clamping elements to hold the drum support at a selected orientation, and a released position, at which the cam permits the clamping elements to move apart sufficiently to free the supporting means to have the orientation thereof shifted.

* * * * *